US009318859B2

(12) United States Patent
Chen

(10) Patent No.: US 9,318,859 B2
(45) Date of Patent: Apr. 19, 2016

(54) ELECTRICAL CONNECTOR ASSEMBLY

(71) Applicant: BING XU PRECISION CO., LTD., New Taipei (TW)

(72) Inventor: Chih-jung Chen, New Taipei (TW)

(73) Assignee: BING XU PRECISION CO., LTD., New Taipei (TW)

( * ) Notice: Subject to any disclaimer, the term of this patent is extended or adjusted under 35 U.S.C. 154(b) by 0 days.

(21) Appl. No.: 14/681,427

(22) Filed: Apr. 8, 2015

(65) Prior Publication Data

US 2015/0295373 A1 Oct. 15, 2015

(30) Foreign Application Priority Data

Apr. 15, 2014 (TW) ..... 103206524 U

(51) Int. Cl.
*H01R 31/06* (2006.01)
*H01R 12/62* (2011.01)
*H01R 13/66* (2006.01)

(52) U.S. Cl.
CPC ..... *H01R 31/06* (2013.01); *H01R 12/62* (2013.01); *H01R 13/6658* (2013.01)

(58) Field of Classification Search
USPC ..... 439/499, 493, 497, 76.1, 541.5, 620.22
See application file for complete search history.

(56) References Cited

U.S. PATENT DOCUMENTS 6,832,931 B1 * 12/2004 Wu ..... 439/499
6,910,914 B1 * 6/2005 Spink, Jr. ..... 439/497
6,976,869 B1 * 12/2005 Wu ..... 439/499
7,563,108 B1 * 7/2009 Wu ..... 439/76.1
7,794,273 B2 * 9/2010 Xu et al. ..... 439/555
8,033,869 B1 * 10/2011 Zhu et al. ..... 439/660
8,133,070 B2 * 3/2012 Hsueh et al. ..... 439/497
8,758,030 B2 * 6/2014 Chen ..... 439/76.1
8,845,341 B2 * 9/2014 Chen et al. ..... 439/76.1
9,219,319 B2 * 12/2015 Chen
2012/0252260 A1 * 10/2012 Tseng et al. ..... 439/499
2013/0109244 A1 * 5/2013 Chen ..... 439/682
2013/0109245 A1 * 5/2013 Tseng ..... 439/682

FOREIGN PATENT DOCUMENTS

TW M463443 U 10/2013

* cited by examiner

*Primary Examiner* — Alexander Gilman
(74) *Attorney, Agent, or Firm* — Hauptman Ham, LLP

(57) ABSTRACT

An electrical connector assembly includes an insulator, a PCB, first terminals, second terminals, and a FFC. The PCB is inserted in the slot. The PCB includes a first conductive parts embedded in the first slot holes and second conductive parts embedded in the second slot holes. The second terminals comprise first contacting parts and second contact parts. The first contacting parts are electrically connected the second conductive parts of the PCB. The insulator further comprises a cable slot, which connects the second slot holes so that the second contacting parts of the second terminals extend into the cable slot, to which the FFC is inserted in. The ends of the conductors are electrically connected the second contacting parts of the second terminals. Thus the problem with the existing soldering technology is solved since soldering is not needed.

17 Claims, 9 Drawing Sheets

ELECTRICAL CONNECTOR ASSEMBLY

CROSS REFERENCE TO RELATED APPLICATION

This application claims the priority of Taiwan Application No. 103206524, filed Apr. 15, 2014. The entire disclosures of each of the above applications are incorporated herein by reference.

BACKGROUND OF THE INVENTION

1. Field of the Invention

The present invention relates to an electrical connector assembly, and especially to a serial advanced technology attachment (SATA) electrical connector assembly that has a flexible flat cable (FFC) and a printed circuit board (PCB).

2. Description of the Prior Art

The existing technology, such as the electrical connector assembly referred to in Taiwan patent no. M463443, comprises an insulating body, a plurality of terminals embedded in the insulator, a PCB electrically connected to the terminals, a flexible transmission unit (herein refers to the FFC) electrically connected to the terminals through the PCB, and a cover body that locks on the insulating body. Each terminal, comprising a contacting part and a soldering part, is soldered to the electrically-connected bonding pad on the PCB through a soldering process. The FFC is also soldered to the electrically-connected bonding pad through the soldering process.

However, the existing cable connector assembly requires complicated soldering equipment and manufacturing procedure to solder the terminals to the PCB. It has a higher overall manufacturing cost, as it is harder to manufacture, demands more complex manual work, and the terminals must be desoldered before maintenance. Therefore, there is a need to improve its structure to meet demands.

SUMMARY OF THE INVENTION

An object of the present invention is to provide an electrical connector assembly which electrically connects the PCB through a flexible contact of metal terminals. Therefore it removes the problem of high cost of the existing soldering process and lowers the difficulty of rework.

According to the present invention, an electrical connector assembly comprises an insulator, a printed circuit board (PCB), a plurality of first terminals, a plurality of second terminals, and a flexible flat cable (FFC). The insulator comprises a slot with a first wall and a second wall. The first wall is installed with a plurality of first slot holes and the second wall is installed with a plurality of second slot holes. The PCB is inserted in the slot. One side of the PCB is equipped with a plurality of first conductive parts facing the first wall, and the opposite side of the PCB is equipped with a plurality of second conductive parts facing the second wall. The plurality of first terminals are embedded in the first slot holes of the insulator. Contacting parts of the first terminals extend into the first slot holes, and ends of the first terminals are electrically connected to the first conductive parts of the PCB. The plurality of second terminals are embedded in the second slot holes of the insulator. The second terminals comprise a plurality of first contacting parts and second contact parts. The first contacting parts are electrically connected the second conductive parts of the PCB. The FFC comprise an insulating layer, which covers a plurality of conductors. The insulator further comprises a cable slot, which connects the second slot holes so that the second contacting parts of the second terminals extend into the cable slot, to which the FFC is inserted in. The ends of the conductors are electrically connected the second contacting parts of the second terminals.

In another aspect of the present invention, the electrical connector assembly further comprises a cover body, locked and fastened to the side of the insulator where the slot locates, comprising a notch to accommodate the FFC.

In another aspect of the present invention, an edge at the end of both sides of the FFC comprises a protruding part, which is blocked by the notch of the cover body.

In another aspect of the present invention, the first slot holes comprise a plurality of power terminal holes and data terminal holes. The first terminals comprise a plurality of power terminals and a plurality of data terminals. The plurality of power terminals are embedded in the power terminal holes of the insulator, with their contacting parts extending into the power terminal holes, and their ends flexibly contact the first conductive parts of the PCB. The plurality of data terminals are embedded in the data terminal holes of the insulator with their contacting parts extending into the data terminal holes and their ends flexibly contact the first conductive parts of the PCB.

In another aspect of the present invention, the slot essentially parallels the cable slot.

In still another aspect of the present invention, the PCB is inserted to the slot along a first direction complying with an extending direction of the slot and the cable slot.

In yet another aspect of the present invention, the second terminals are blanking type terminals or forming type terminals.

According to the present invention, an electrical connector assembly comprises an insulator, a printed circuit board (PCB), a plurality of first terminals, a plurality of second terminals, and a flexible flat cable (FFC). The insulator comprises a slot comprising a first wall and a second wall. The first wall is installed with a plurality of first slot holes and the second wall is installed with a plurality of second slot holes. The PCB is inserted in the slot. One side of the PCB is equipped with a plurality of first conductive parts facing the first wall, and the opposite side of the PCB is equipped with a plurality of second conductive parts facing the second wall. The plurality of first terminals are embedded in the first slot holes of the insulator. Contacting parts of the first terminals extend into the first slot holes, and ends of the first terminals are electrically connected to the first conductive parts of the PCB. The plurality of second terminals embedded in the second slot holes of the insulator, comprise a plurality of first contacting parts and second contacting parts. The first contacting parts are electrically connected the second conductive parts of the PCB. The FFC comprises an insulating layer covering a plurality of conductors with its end forming an inserting part, an overlapping part and a bending part that connects the inserting part and the overlapping part. The insulator further comprises a cable slot, which connects the second slot holes so that the second contacting parts of the second terminals extend into the cable slot. The opening direction of the cable slot is opposite to that of the slot. The FFC's inserting part is inserted in the cable slot, and its overlapping part is fixed on the insulator. The ends of the conductors electrically connect the second contacting parts of the second terminals.

In one aspect of the present invention, the insulator comprises an accommodating seat on top of it to accommodate the overlapping part of the FFC.

In another aspect of the present invention, the electrical connector assembly further comprises a fastener to fasten the overlapping part to the accommodating seat.

In another aspect of the present invention, the fastener is an adhesive tape or a glue.

In another aspect of the present invention, the electrical connector assembly further comprises a cover body locking and fastening to the insulator on the side where the slot locates.

In another aspect of the present invention, the edge at the end of both sides of the inserting part of the FFC comprises a protruding part.

In another aspect of the present invention, the first slot holes comprise a plurality of power terminal holes and data terminal holes, and the first terminals comprise: a plurality of power terminals embedded in the power terminal holes of the insulator, with their contacting parts extending into the power terminal holes, and their ends flexibly contact the first conductive parts of the PCB; and a plurality of data terminals embedded in the data terminal holes of the insulator with their contacting parts extending into the data terminal holes and their ends flexibly contact the first conductive parts of the PCB.

In another aspect of the present invention, the slot essentially parallels the cable slot.

In still another aspect of the present invention, the PCB is inserted to the slot along a first direction complying with an extending direction of the slot and the cable slot.

In yet another aspect of the present invention, the second terminals are blanking type terminals or forming type terminals.

Comparing with the existing technology, the present invention installs the PCB between the first and second terminals, which are electrically connected through a flexible contact of metal made possible by the design of a slot and cable slot on the insulator. Thus the problem with the existing soldering technology is solved since soldering is not needed. In addition, in another embodiment, the fixation is realized by bending the FFC, which strengthens the connection between the FFC and the insulator, and the connection can be further enhanced by a fastener.

These and other objectives of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 1:
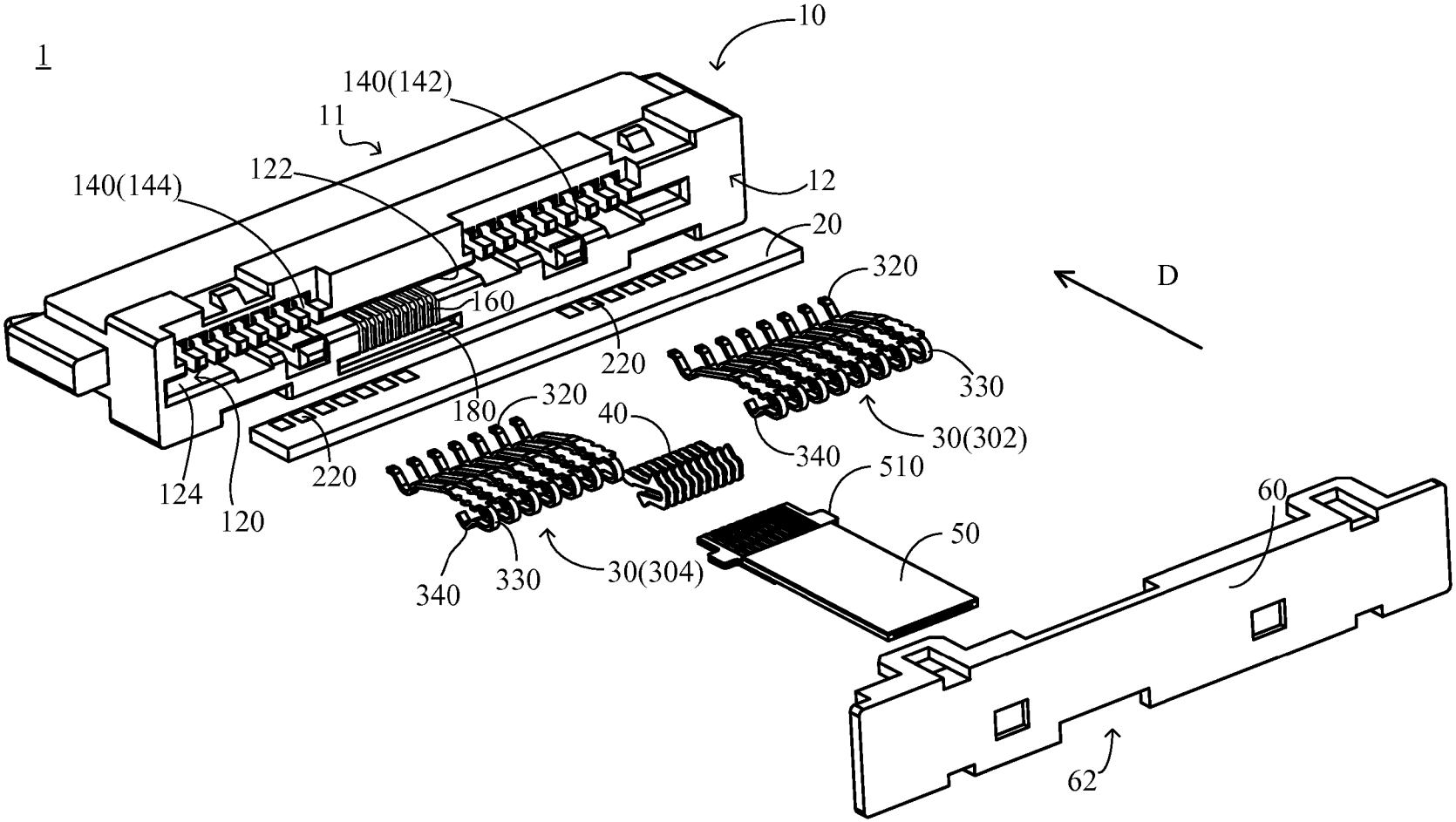
FIG. 1 illustrates an exploded diagram of a preferred embodiment of the electrical connector assembly of the present invention.
Figure 2:
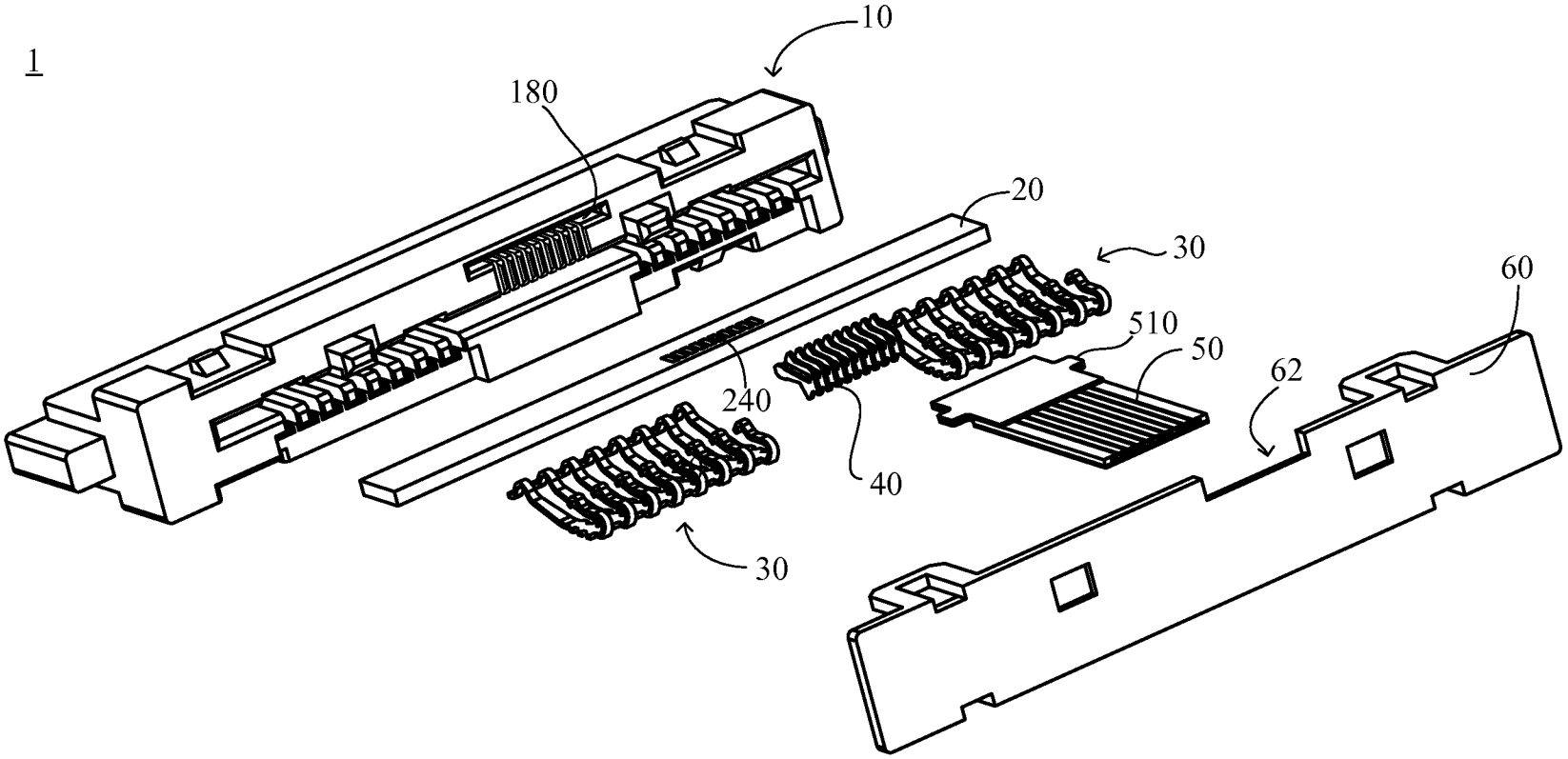
FIG. 2 shows an exploded diagram of the preferred embodiment from another perspective.
Figure 3:
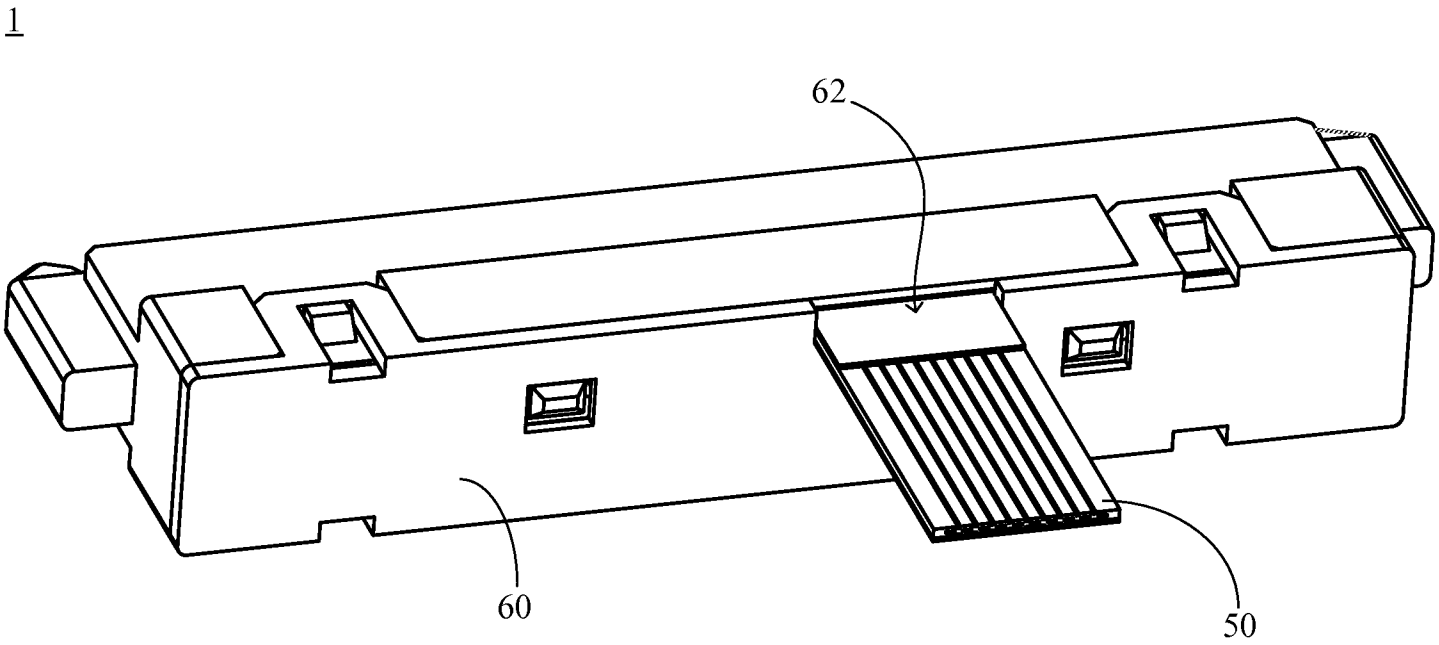
FIG. 3 shows a three-dimensional view of the preferred embodiment.

Please refer to figures from FIGS. 1 to 3. FIG. 1 illustrates an exploded diagram of a preferred embodiment of the electrical connector assembly of the present invention. FIG. 2 shows an exploded diagram of the preferred embodiment from another perspective. FIG. 3 shows a three-dimensional view of the preferred embodiment. The electrical connector assembly 1 of the preferred embodiment comprises an insulator 10, a printed circuit board (PCB) 20, a plurality of first terminals 30, a plurality of second terminals 40, a flexible flat cable (FFC) 50 and a cover body 60.

The insulator 10, preferably, conforms with the SATA standard connectors. It is mainly made of, for example, plastic materials. It has a first side 11 (herein refers to the front side of the insulator 10) and a second side 12 (herein refers to the back side of the insulator 10). The second side 12 of the insulator 10 has a slot 120, comprising a first wall 122 and a second wall 124. The first wall 122 has a plurality of first slot holes 140 which, preferably, conform with the SATA standard and are installed on the insulating body 1 with a space between each hole. The second wall has a plurality of second slot holes 160.

Please refer to FIGS. 1 and 2 together. The PCB 20 is installed in the slot 120. One side of the PCB 20 has a plurality of first conductive parts 220, facing the first wall 122. The other side of the PCB 120 has a plurality of second conductive parts 240, facing the second wall 124. The first conductive parts 220 electrically connect the second conductive parts 240 through wires inside the PCB 20.

As shown in FIG. 1, the first terminals 30 are embedded in the first slot holes 140 of the insulator 10. Contacting parts 320 of the first terminals 30 extend into the first slot holes 140, and ends 340 of the plurality of terminals 30 electrically connect the first conductive parts 220 of the PCB 20. Specifically, the first terminal 30 further comprise a bending part 330. The bending part 330 can help the end 340 flexibly connects the first conductive part 220, so that soldering is not needed to attain to electrical connection.

More specifically, the first slot hole 140 comprises a plurality of power terminal holes 142 and a plurality of data terminal holes 144. Similarly, the first terminal 30 comprises a plurality of power terminals 302 and a plurality of data terminals 304. The power terminal 302 is embedded in the power terminal hole 142 of the insulator 10. A contacting part 320 of the power terminal 302 extends into the power terminal hole 142, and the end 340 of the power terminal 302 flexibly contacts the first conductive part 220 of the PCB 20. Similarly, the data terminal 304 is embedded in the data terminal hole 144 of the insulator 10, and the contacting part 320 of the data terminal 304 extends into the data terminal hole 144, and the end 340 of the data terminal 304 flexibly contacts the first conductive part 220 of the PCB 20. The power terminal hole 142 and data terminal hole 144 are separately installed in the insulator 10. The first conductive part 220 is also divided into two sets accordingly.

Figure 4:
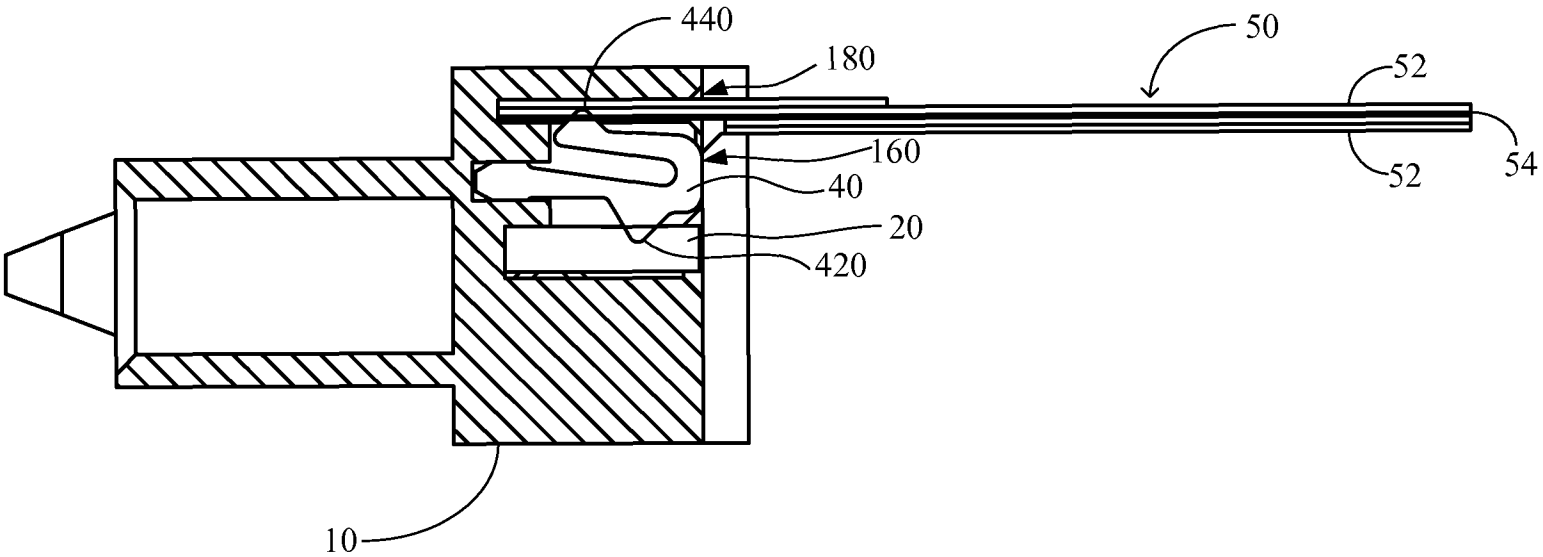
FIG. 4 is a sectional view of the second slot hole of the electrical connector assembly of the preferred embodiment.

Please also refer to FIG. 4. FIG. 4 is a sectional view of the second slot hole of the electrical connector assembly of the preferred embodiment. The second terminal 40 is embedded into the second slot hole 160 of the insulator 10. The second terminal 40 has a first contacting part 420 and a second contacting part 440. The first contacting part 420 electrically connects the second conductive part 240 of the PCB 20. The second terminal 40 is a blanking type terminal in the present embodiment. It can be a forming type terminal in other embodiments.

As shown in FIG. 4, the FFC 50 has an insulating layer 52, which covers a plurality of conductors 54. The insulator 10 is further installed with a cable slot 180, which connects the second slot hole 160 so that the second contacting part 440 of the second terminal 40 extends into the cable slot 180. The FFC 50 is inserted in the cable slot 180, and the end of the conductor 54 electrically connects the second contacting part 440 of the second terminal 40, so that soldering is not needed to attain to electrical connection. One thing worth mentioning is that the slot 120 essentially parallels the cable slot 180, as shown in FIG. 1 and FIG. 2. In other words, both the PCB 20 and the FFC 50 are inserted into the slot 120 and the cable slot 180 in parallel. The PCB 20 is inserted to the slot 120 along a first direction D complying with an extending direction of the slot 120 and the cable slot 180.

As shown in figures from FIGS. 1 to 3, the cover body 60 is locked and fastened to one side (the second side 12) of the insulator 10 where the slot 120 locates. The cover body 60 has a notch 62 to accommodate the FFC 50. In addition, on the edge at the end of both sides of the FFC 50, there is a protruding part 510. The notch 62 of the cover body 60 can block the protruding part 510 so to prevent the FFC 50 from falling out of the cable slot 180.

Figure 5:
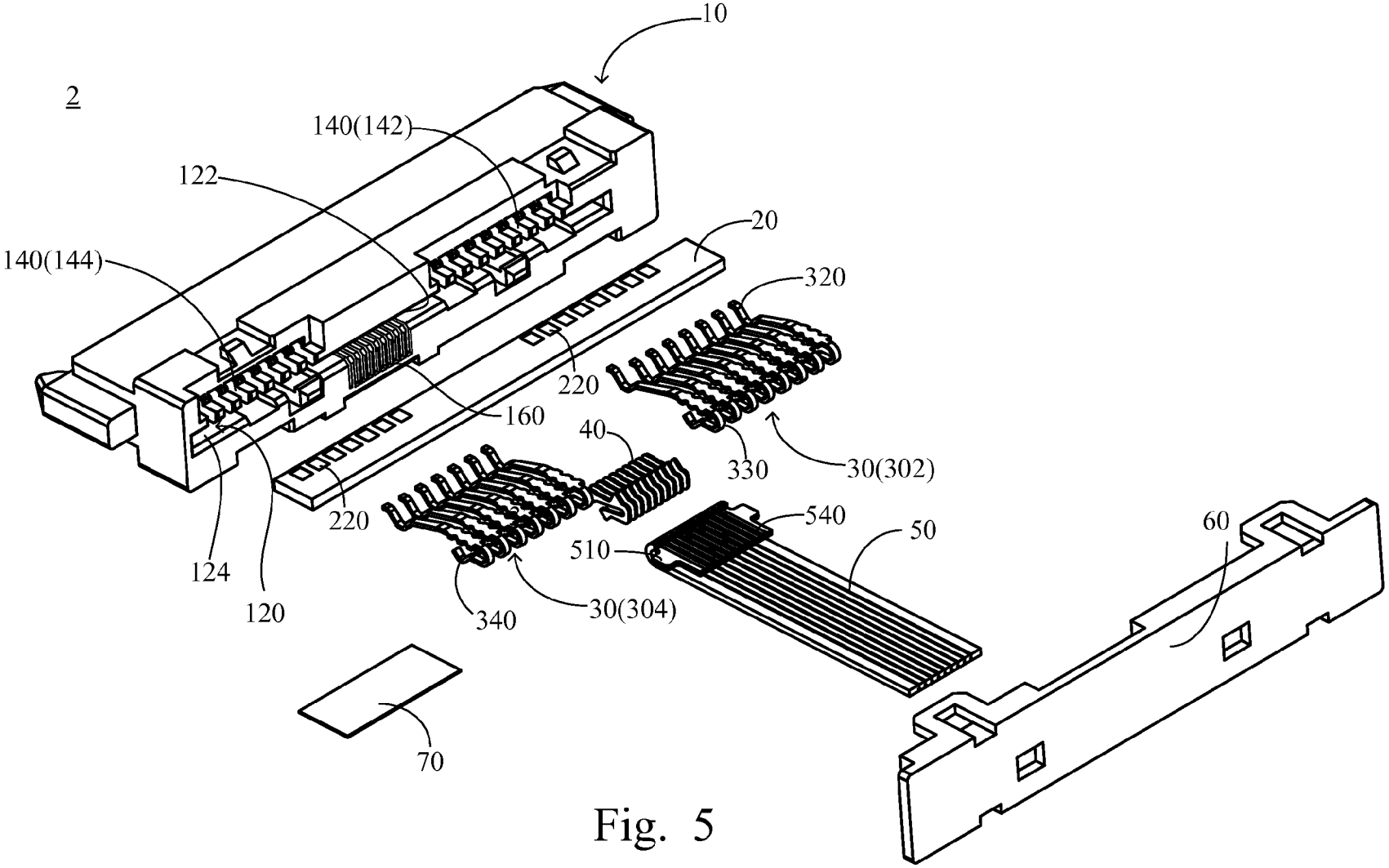
FIG. 5 shows an exploded diagram of the present preferred embodiment of the electrical connecter assembly of the present invention.
Figure 6:
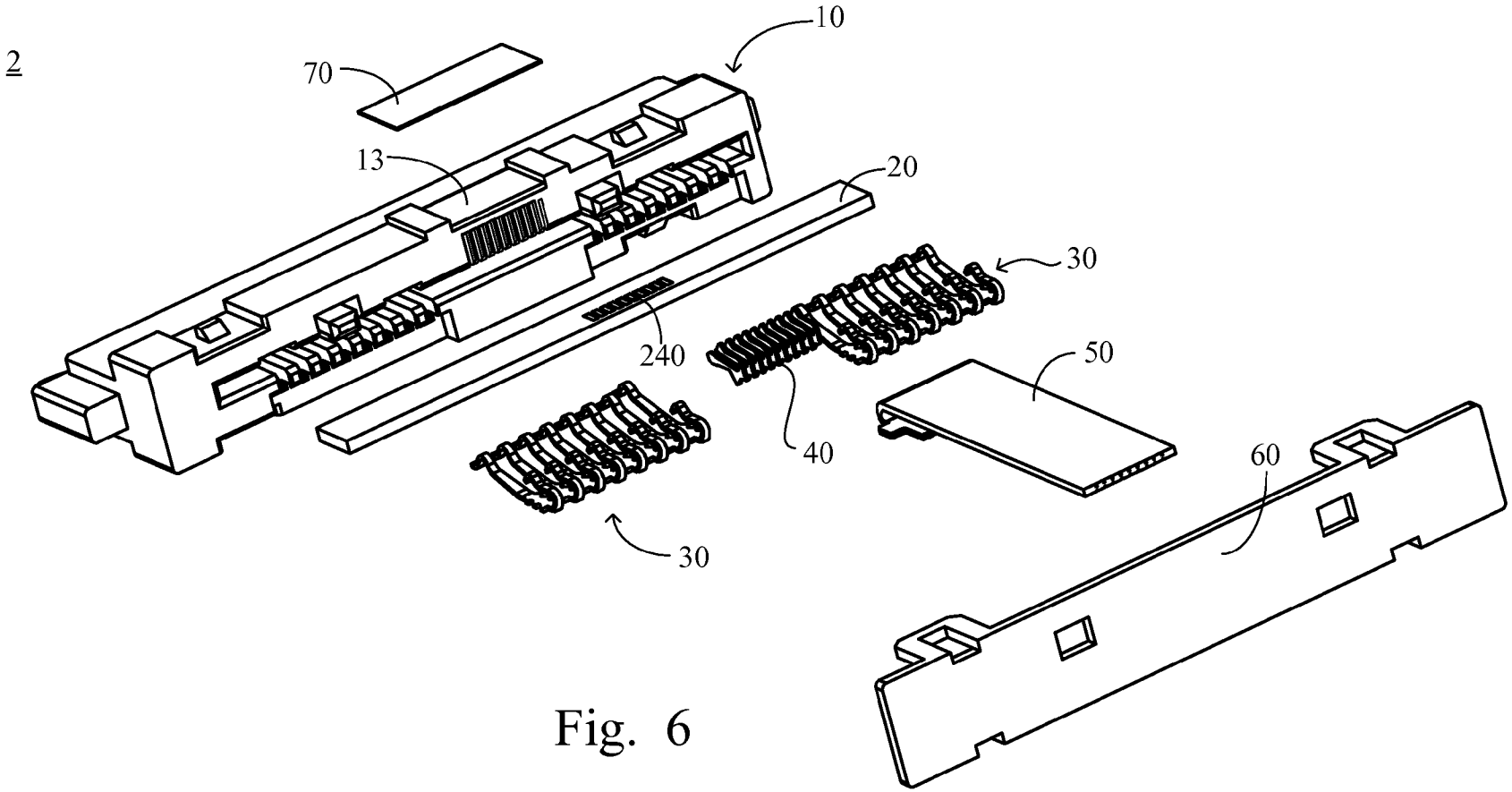
FIG. 6 shows an exploded diagram of the present preferred embodiment from another perspective.

Another preferred embodiment is introduced in detail hereafter. Please refer to FIGS. 5 and 6. FIG. 5 shows an exploded diagram of the present preferred embodiment of the electrical connecter assembly of the present invention. FIG. 6 shows an exploded diagram of the present preferred embodiment from another angle. The present preferred embodiment of the electrical connector assembly 2 comprises an insulator 10, a PCB 20, a plurality of first terminals 30, a plurality of second terminals 40, a FFC 50, a cover body 60 and a fastener 70.

The insulator 10, preferably, conforms with the SATA standard. It is mainly made of, for example, plastic materials. It has a slot 120, comprising a first wall 122 and a second wall 124. The first wall 122 has a plurality of first slot holes 140 which, preferably, conform with the SATA standard and are installed on the insulating body 1 with a space between each hole. The second wall has a plurality of second slot holes 160.

Please refer to FIGS. 5 and 6 together. The PCB 20 is inserted in the slot 120. One side of the PCB 20 has a plurality of first conductive parts 220, facing the first wall 122. The other side of the PCB 120 has a plurality of second conductive parts 240, facing the second wall 124. The first conductive parts 220 electrically connect the second conductive parts 240 through wires inside the PCB 20.

As shown in FIG. 5, the first terminals 30 are embedded in the first slot holes 140 of the insulator 10. Contacting parts 320 of the first terminals 30 extend into the first slot holes 140, and ends 340 of the plurality of terminals 30 electrically connect the first conductive parts 220 of the PCB 20. Specifically, the first terminal 30 further comprises a bending part 330. The bending part 330 can help the end 340 flexibly connects the first conductive part 220, so that soldering is not needed to attain to electrical connection.

The first slot hole 140 comprises a plurality of power terminal holes 142 and a plurality of data terminal holes 144. Similarly, the first terminal 30 comprises a plurality of power terminals 302 and a plurality of data terminals 304. The power terminal 302 is embedded in the power terminal hole 142 of the insulator 10. A contacting part 320 of the power terminal 302 extends into the power terminal hole 142, and the end 340 of the power terminal 302 flexibly contacts the first conductive part 220 of the PCB 20. Similarly, the data terminal 304 is embedded in the data terminal hole 144 of the insulator 10, and the contacting part 320 of the data terminal 304 extends into the data terminal hole 144, and the end 340 of the data terminal 304 flexibly contacts the first conductive part 220 of the PCB 20.

Figure 7:
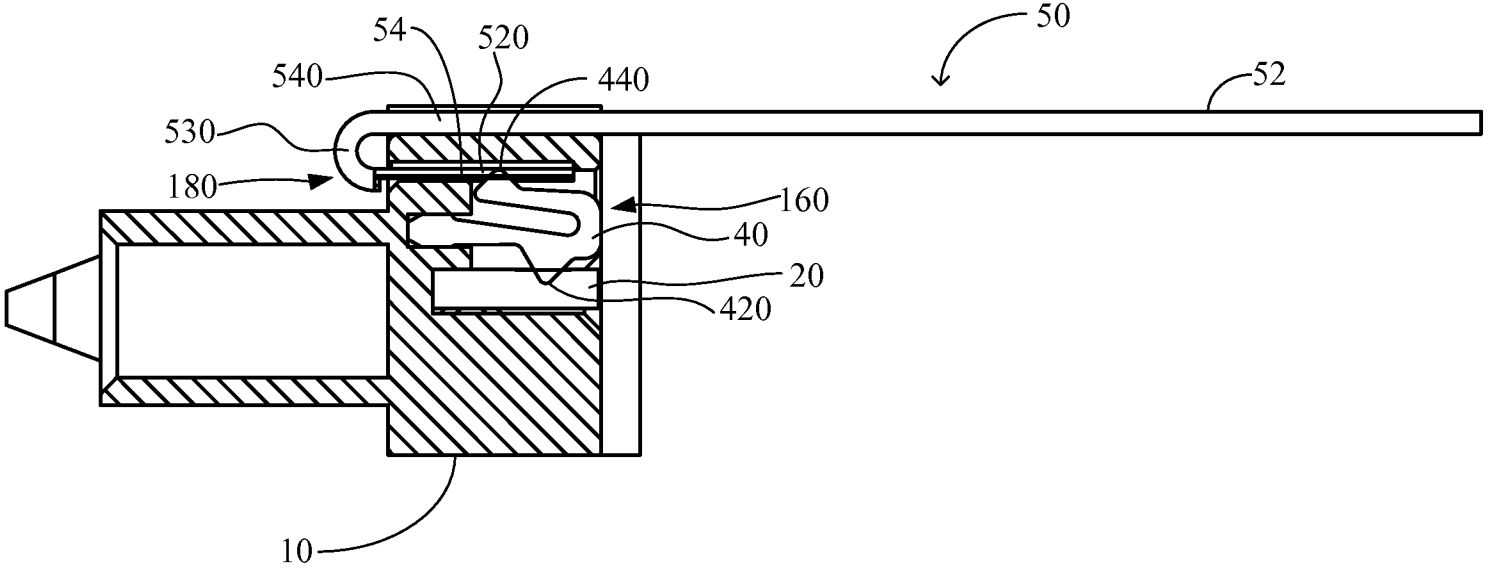
FIG. 7 shows a sectional view of the second slot hole of the electrical connector assembly of the present preferred embodiment.

Please also refer to FIG. 7. FIG. 7 shows a sectional view of the second slot hole of the electrical connector assembly of the present preferred embodiment. The second terminal 40 is embedded into a second slot hole 160 of the insulator 10. The second terminal 40 has a first contacting part 420 and a second contacting part 440. The first contacting part 420 electrically connects the second conductive part 240 of the PCB 20. The second terminal 40 of the present embodiment is a blanking type terminal. It can be a forming type terminal in other embodiments.

As shown in FIG. 7, the FFC 50 has an insulating layer 52, which covers a plurality of conductors 54. The end of the FFC 50 forms an inserting part 520, an overlapping part 540 and a bending part 530 that connects the inserting part 520 and the overlapping part 540.

Figure 8:
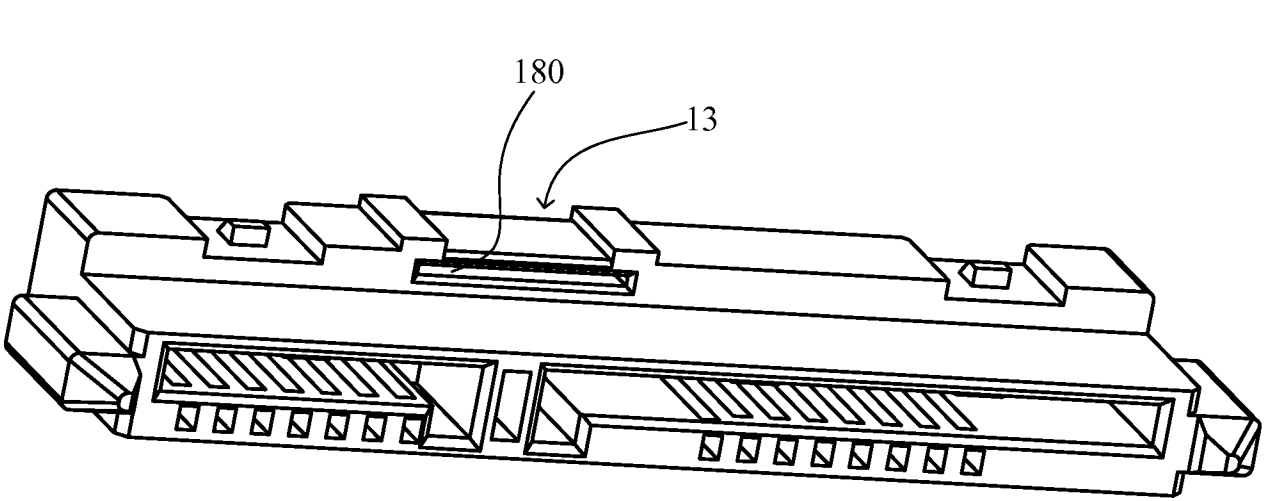
FIG. 8 shows a three-dimensional view of the insulator according to the preferred embodiment of the present invention.

Please refer to FIGS. 7 and 8 together. FIG. 8 shows a three-dimensional view of the insulator according to the preferred embodiment of the present invention. The insulator 10 is further installed with a cable slot 180, which connects the second slot hole 160 so that the second contacting part 440 of the second terminal 40 extends into the cable slot 180. Different from the previous embodiment, the opening of the cable slot 180 is facing a direction that is opposite to that of the slot 120. The inserting part 520 of the FFC 50 is inserted in the cable slot 180, with the overlapping part 540 fixed on the insulator 10. The end of the conductor 54 electrically connects the second contacting part 440 of the second terminal 40, so that soldering is not needed to attain to electrical connection.

Figure 9:
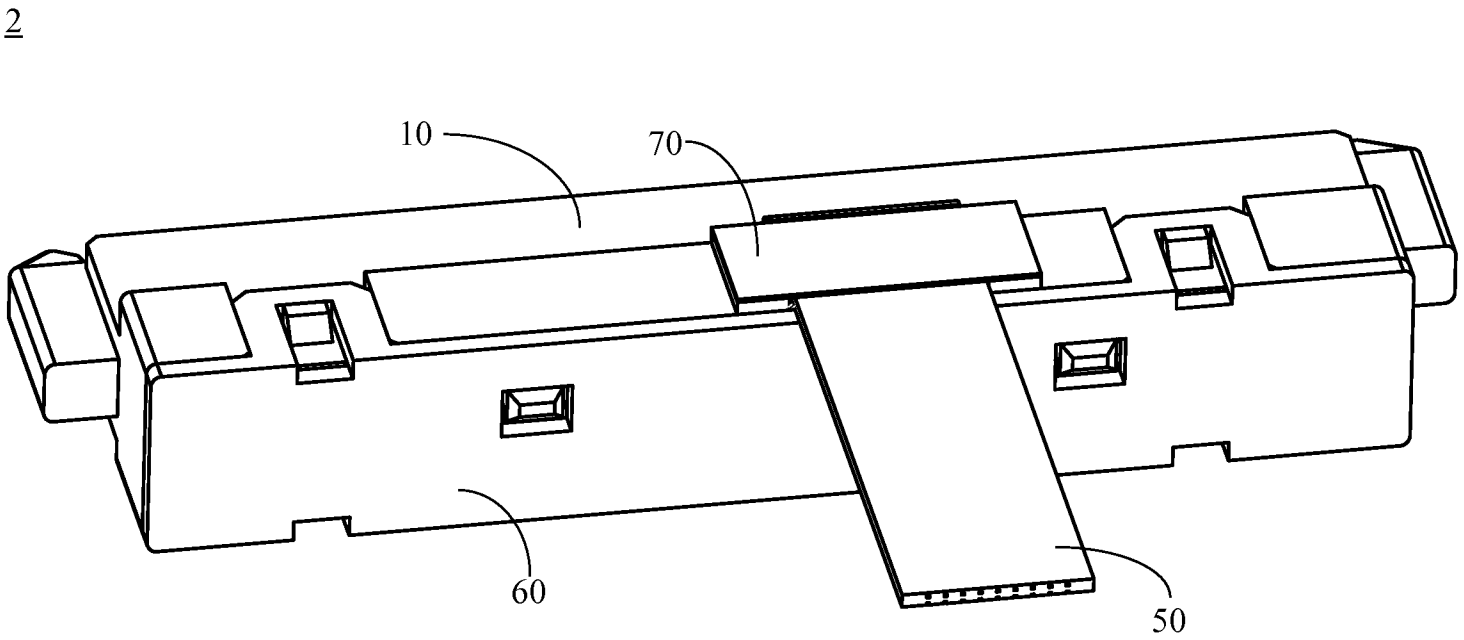
FIG. 9 shows a three-dimensional view of the electrical connector assembly of the present preferred embodiment.

Please refer to figures from FIG. 5 to FIG. 9. FIG. 9 shows a three-dimensional view of the electrical connector assembly of the present preferred embodiment. The insulator has an accommodating seat 13, so to accommodate the overlapping part 540 of the FFC 50. The fastener 70 is for fastening the overlapping part 540 to the accommodating seat 13. Preferably, the fastener 70 is an adhesive tape or a glue, so to prevent the FFC 50 from falling off.

As shown in figures from FIG. 1 to FIG. 3, the cover body 60 is locked and fastened to one side of the insulator 10 where the slot 120 locates. Similarly, on the edge of both sides of the inserting part 540 of the FFC 50, there is a protruding part 510, to fix the FFC 50 in the cable slot 180. Similarly, the slot 120 essentially parallels the cable slot 180. In other words, the PCB 20 and the FFC 50 are inserted into the slot 120 and cable slot 180 in parallel, with the direction of insertion opposite to each other.

In summary, the PCB 20 of the present invention is installed between the first terminal 30 and second terminal 40, which are electrically connected through flexible metal connection without soldering because of the design of the slot 120 and cable slot 180 of the insulator 10. It solves the existing problem with soldering. In addition, in the other embodiment, the fixation of the FFC 50 through bending strengthens the connection between the FFC 50 and the insulator 10, and the connection can be further enhanced by the fastener 70.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An electrical connector assembly, comprising:

an insulator, with a slot comprising a first wall and a second wall, with the first wall installed with a plurality of first slot holes and the second wall installed with a plurality of second slot holes;

a printed circuit board (PCB) inserted in the slot, with one side of the PCB equipped with a plurality of first conductive parts facing the first wall, and the opposite side of the PCB equipped with a plurality of second conductive parts facing the second wall;

a plurality of first terminals embedded in the first slot holes of the insulator, with contacting parts of the first terminals extending into the first slot holes, and ends of the first terminals electrically connecting to the first conductive parts of the PCB;

a plurality of second terminals, embedded in the second slot holes of the insulator, comprising a plurality of first contacting parts and second contact parts, with the first contacting parts electrically connecting the second conductive parts of the PCB; and a flexible flat cable (FFC), comprising an insulating layer, which covers a plurality of conductors;

wherein the insulator further comprises a cable slot, which connects the second slot holes so that the second contacting parts of the second terminals extend into the cable slot, to which the FFC is inserted in; the ends of the conductors electrically connect the second contacting parts of the second terminals.

2. The electrical connector assembly of claim 1 further comprising a cover body, locked and fastened to the side of the insulator where the slot locates, comprising a notch to accommodate the FFC.

3. The electrical connector assembly of claim 2, wherein an edge at the end of both sides of the FFC comprises a protruding part, which is blocked by the notch of the cover body.

4. The electrical connector assembly of claim 1, wherein the first slot holes comprise a plurality of power terminal holes and data terminal holes, and the first terminals comprise:

a plurality of power terminals embedded in the power terminal holes of the insulator, with their contacting parts extending into the power terminal holes, and their ends flexibly contact the first conductive parts of the PCB; and a plurality of data terminals embedded in the data terminal holes of the insulator with their contacting parts extending into the data terminal holes and their ends flexibly contact the first conductive parts of the PCB.

5. The electrical connector assembly of claim 1, wherein the slot essentially parallels the cable slot.

6. The electrical connector assembly of claim 5, wherein the PCB is inserted to the slot along a first direction complying with an extending direction of the slot and the cable slot.

7. The electrical connector assembly of claim 1, wherein the second terminals are blanking type terminals or forming type terminals.

8. An electrical connector assembly, comprising:

an insulator with a slot comprising a first wall and a second wall, with the first wall installed with a plurality of first slot holes and the second wall installed with a plurality of second slot holes;

a printed circuit board (PCB) inserted in the slot, with one side of the PCB equipped with a plurality of first conductive parts facing the first wall, and the opposite side of the PCB equipped with a plurality of second conductive parts facing the second wall;

a plurality of first terminals, embedded in the first slot holes of the insulator, with contacting parts of the first terminals extending into the first slot holes, and ends of the first terminals electrically connecting to the first conductive parts of the PCB;

a plurality of second terminals, embedded in the second slot holes of the insulator, comprising a plurality of first contacting parts and second contacting parts, with the first contacting parts electrically connecting the second conductive parts of the PCB; and a flexible flat cable (FFC), comprising an insulating layer covering a plurality of conductors, with its end forming an inserting part, an overlapping part and a bending part that connects the inserting part and the overlapping part;

wherein the insulator further comprises a cable slot, which connects the second slot holes so that the second contacting parts of the second terminals extend into the cable slot, wherein the opening direction of the cable slot is opposite to that of the slot; the FFC's inserting part inserted in the cable slot; the ends of the conductors electrically connect the second contacting parts of the second terminals.

9. The electrical connector assembly of claim 8, wherein the insulator comprises an accommodating seat on top of it to accommodate the overlapping part of the FFC.

10. The electrical connector assembly of claim 9 further comprising a fastener to fasten the overlapping part to the accommodating seat.

11. The electrical connector assembly of claim 10, wherein the fastener is an adhesive tape or a glue.

12. The electrical connector assembly of claim 8 further comprising a cover body locking and fastening to the insulator on the side where the slot locates.

13. The electrical connector assembly of claim 8, wherein the edge at the end of both sides of the inserting part of the FFC comprises a protruding part.

14. The electrical connector assembly of claim 8, wherein the first slot holes comprise a plurality of power terminal holes and data terminal holes, and the first terminals comprise:

a plurality of power terminals embedded in the power terminal holes of the insulator, with their contacting parts extending into the power terminal holes, and their ends flexibly contact the first conductive parts of the PCB; and a plurality of data terminals embedded in the data terminal holes of the insulator with their contacting parts extending into the data terminal holes and their ends flexibly contact the first conductive parts of the PCB.

15. The electrical connector assembly of claim 8, wherein the slot essentially parallels the cable slot.

16. The electrical connector assembly of claim 15, wherein the PCB is inserted to the slot along a first direction complying with an extending direction of the slot and the cable slot.

17. The electrical connector assembly of claim 8, wherein the second terminals are blanking type terminals or forming type terminals.

* * * * *